US008425086B2

(12) United States Patent
Chen et al.

(10) Patent No.: US 8,425,086 B2
(45) Date of Patent: Apr. 23, 2013

(54) LIGHT EMITTING DIODE LAMP STRUCTURE

(75) Inventors: Chih-Hung Chen, Taipei (TW); Wen-Hsiang Chien, Taipei (TW)

(73) Assignee: Advanced Connectek Inc., Taipei (TW)

( * ) Notice: Subject to any disclaimer, the term of this patent is extended or adjusted under 35 U.S.C. 154(b) by 412 days.

(21) Appl. No.: 12/635,439

(22) Filed: Dec. 10, 2009

(65) Prior Publication Data

US 2011/0062847 A1 Mar. 17, 2011

(30) Foreign Application Priority Data

Sep. 15, 2009 (TW) ..... 98130990 A

(51) Int. Cl.
*F21V 29/00* (2006.01)

(52) U.S. Cl.
USPC ..... 362/294; 362/373; 362/547; 313/11; 313/46

(58) Field of Classification Search ..... D26/1–4, D26/493; 313/11, 45–46; 362/800, 555, 362/612, 545, 547, 249.02, 311.02, 218, 362/294, 373, 364, 362
See application file for complete search history.

(56) References Cited

U.S. PATENT DOCUMENTS

| | | | | |
|---|---|---|---|---|
| 7,434,964 | B1 * | 10/2008 | Zheng et al. | 362/294 |
| 7,524,089 | B2 * | 4/2009 | Park | 362/294 |
| 7,534,015 | B2 * | 5/2009 | Xu et al. | 362/373 |
| 7,658,510 | B2 * | 2/2010 | Russell | 362/249.02 |
| 7,950,826 | B2 * | 5/2011 | Shin | 362/249.02 |
| 2008/0291663 | A1 * | 11/2008 | Wedell et al. | 362/147 |
| 2008/0316755 | A1 * | 12/2008 | Zheng et al. | 362/373 |
| 2009/0046473 | A1 * | 2/2009 | Tsai et al. | 362/373 |
| 2009/0323325 | A1 * | 12/2009 | Long et al. | 362/234 |
| 2010/0314985 | A1 * | 12/2010 | Premysler | 313/46 |
| 2011/0089838 | A1 * | 4/2011 | Pickard et al. | 315/113 |
| 2011/0115358 | A1 * | 5/2011 | Kim | 313/46 |

* cited by examiner

*Primary Examiner* — Anne Hines
*Assistant Examiner* — Jose M Diaz
(74) *Attorney, Agent, or Firm* — C. G. Mersereau; Nikolai & Mersereau, P.A.

(57) ABSTRACT

The present invention is a light emitting diode lamp structure, which comprises a heat dissipating plane, a light emitting housing and a base. The light emitting housing further comprises a casing and a first hollow region. The heat dissipating plane is partly covered by the casing and the rest of the heat dissipating plane is shown in the first hollow region. The part of the heat dissipating plane covered by the casing further includes a plurality of LEDs. The base is mounted with the light emitting housing and electrically engaged with the LEDs.

8 Claims, 8 Drawing Sheets

LIGHT EMITTING DIODE LAMP STRUCTURE

BACKGROUND

1. Field of the Invention

The invention relates to a light emitting diode lamp structure. More particularly the invention relates to a lamp structure with better heat dissipation.

2. Description of Related Art

Because of the relatively high efficiency, high intensity, cost effectiveness and longer operation life, the light emitting diode (LED) has been increasingly and popularly used in all type of light assembly.

The level of luminous flux of the LED is characterized not only by its size but also by its heat dissipating efficiency, which is critical. The LED in operation accumulates a great deal of heat, which causes the temperature of the LED to rise. High temperature substantially decreases light output efficiency and shortens the service life of the LED. Thus, in prior invent the LED structure must include a heat dissipating unit to allow the LED to work in high temperature.

Conventionally, the LED was manufactured in a similar construction of the light bulb, in which the LED was mounted on a base. When the LED is in operation, the base absorbs and transfers the heat generated by the LED to the air. Moreover, to provide electric power to the LED, the base must embed and electrically engage with a lamp holder. In this case, a part of the base is covered by the lamp holder, and the base could not transfer the heat to the air, further decrease efficiency of the LED. Thus, heat dissipating is a problem to be solved to improve the performance of the LED.

In light of the drawbacks of the conventional LED, the inventor with many years of experience in industry develops a LED lamp structure.

BRIEF SUMMARY OF THE INVENTION

According to the aforesaid shortcoming, a primary object of this invention is to provide a LED lamp structure with brighter light output and higher heat dissipation efficiency.

To achieve this objective, the present invention discloses a LED lamp structure, which has a heat dissipating plane, a light emitting housing and a base. The heat dissipating plane comprises a plurality of LED elements. In addition, the light emitting housing further comprises a casing and a first hollow region. The heat dissipating plane is partly embedded in the casing and partly revealed through the first hollow region. The LED elements are also covered by the casing, and the heat dissipating plane can dissipate heat from the first hollow region. The base can be mounted with the light emitting housing. Furthermore; the LED elements can also be electrically engaged with the base.

The heat dissipating plane may further include embossments, recesses or other structures that could increase the heat dissipating area.

The heat dissipating plane may also include a second hollow region. The second hollow region can match the first hollow region, which is on the light emitting housing. Air goes through the first hollow region and the second hollow region to form an air cycle. The air cycle could obtain better heat dissipating efficiency.

Representative advantages offered by this invention may be briefly summarized below.

(1) The present invention which includes a plurality of LEDs enabled to increase brightness.

(2) The present invention increases efficiency of heat dissipation and heat conductivity, thus effectively avoiding the problem of thermal degradation of LEDs.

These and other features of the invention will be described in further detail in the following detailed description of a presently preferred embodiment.

BRIEF DESCRIPTION OF THE SEVERAL VIEWS OF THE DRAWINGS

The technical means adopted by the present invention to achieve the above and other objects can be best understood by referring to the following detailed description of the preferred embodiments and the accompanying drawings, in which.

DETAILED DESCRIPTION OF THE INVENTION

An exemplary embodiment of present invention will hereinafter be described in detail with reference to the accompanying drawing. As those skilled in the art would realize, the described embodiments may be modified in various different ways, all without departing from the spirit or scope of the present invention.

Figure 1:
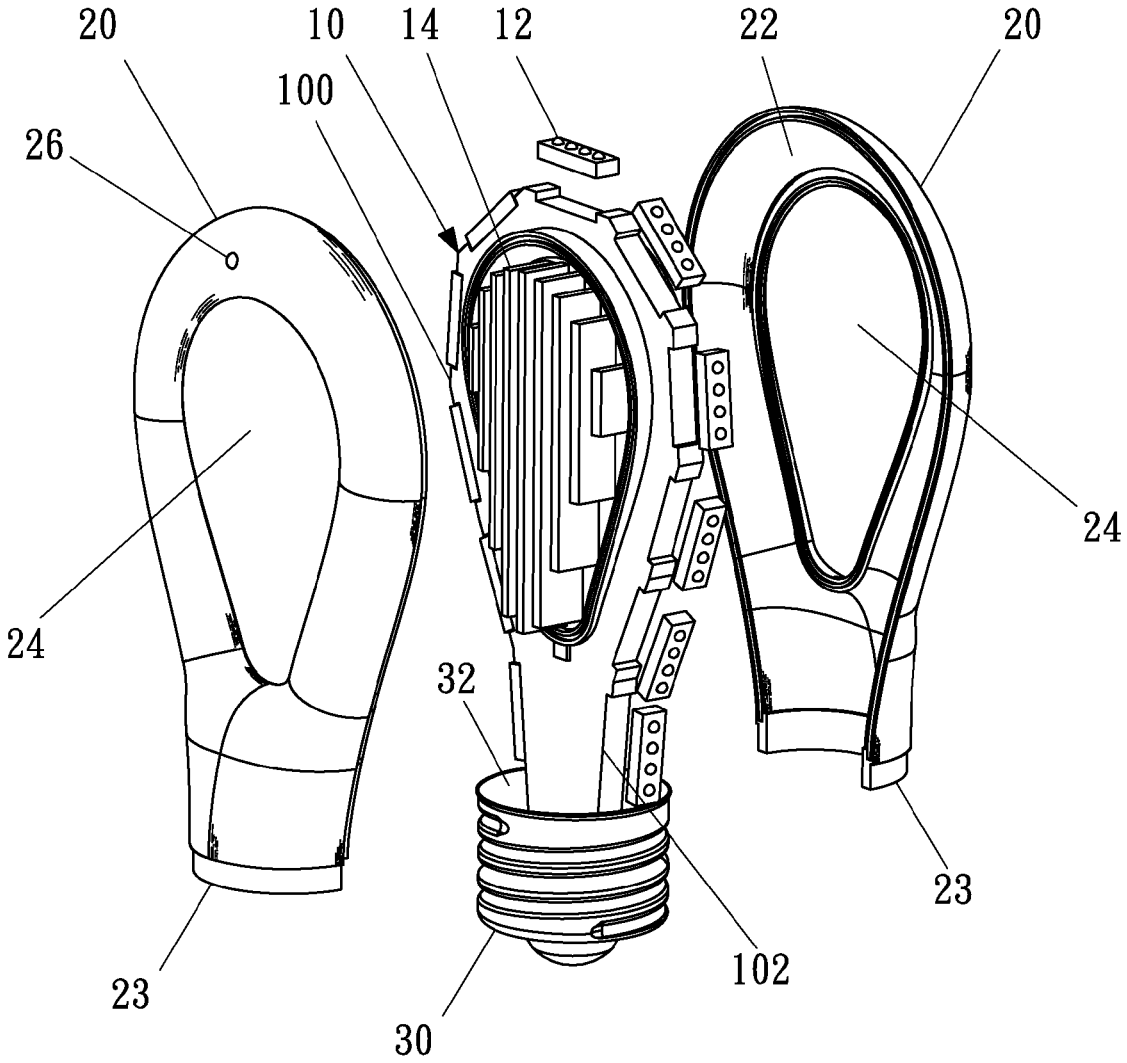
FIG. 1 is an exploded view of a LED lamp structure according to a first embodiment of present invention.
Figure 2:
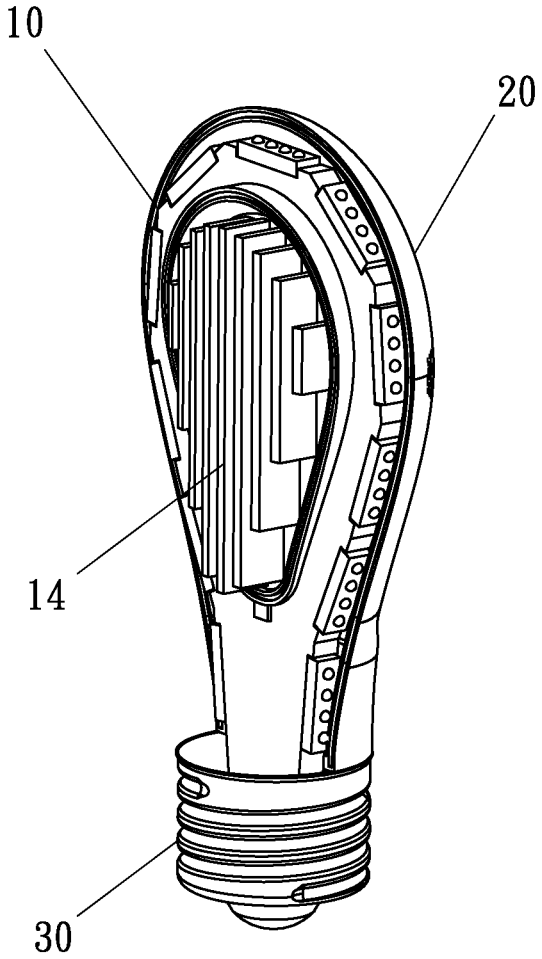
FIG. 2 is a partly assembled perspective view of a LED lamp structure according to a first embodiment of the present invention.
Figure 3:
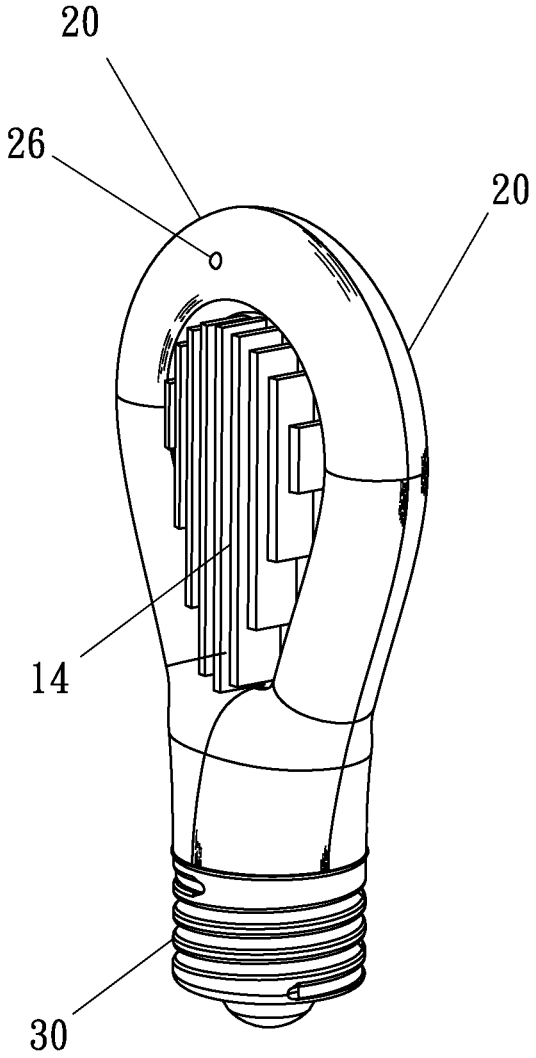
FIG. 3 is a perspective view of a LED lamp structure according to a first embodiment of the present invention.

Referring to FIGS. 1~3, the light emitting diode (LED) lamp structure constructed in accordance with the present invention has a heat dissipating plane 10, a light emitting housing, and a base 30.

The heat dissipating plane 10 is thermally conductive so that the heat dissipating plane 10 is able to make from aluminum or the like. The heat dissipating plane 10 is a racket-like structure, in which the racket-like structure comprises an upper portion 100 and a handle portion 102. Moreover, a plurality of LED elements 12 are formed on the periphery of the upper portion 100.

The light emitting housing is able to make from glass, acrylic or the like. The light housing can be constructed by two transparent elements 20, which when combined could form a casing 22. Each of the transparent elements 20 has a first hollow region 24 in the center, and the heat dissipating plane 10 would be clamped between the two transparent elements 20. The casing 22 covers the plurality of LED elements 12 on the periphery of the upper portion 100. Furthermore, the upper portion 100 of the heat dissipating plane 10 is partly revealed through the first though-hole 24 so as to obtain better heat dissipating efficiency.

Figure 4:
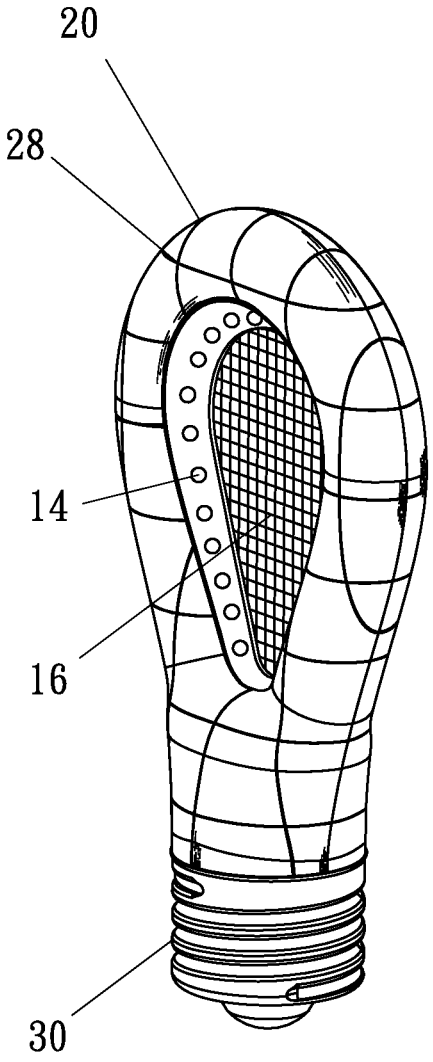
FIG. 4 is a perspective view of a LED lamp structure according to a second embodiment of the present invention.

Further, the heat dissipating plane 10 comprises an embossment or a recess, which is referred to as a first embossment 14 or a first recess 16 (shown in FIG. 4). The first embossment 14 or the first recess 16 would be revealed through the first though-hole 24. The major object is to increase the overall heat dissipating area and improve heat dissipation. The first embossment 14 could be a lamellar structure, a schistose structure, an embossing surface or the like. Furthermore, the first recess 16 could be a cancellated structure, a wave structure, a scaly structure or the like.

Furthermore, heat generated from the LED elements 12 could be dissipate through the transparent elements 20. Each of the transparent elements 20 also has a second embossment 28 or a second recess 28 (shown in FIG. 4) to increase the overall heat dissipating area and dissipate heat efficiently. The second embossment 28 could be a lamellar structure, a schistose structure, an embossing surface or the like. Moreover, the second recess 28 could be a cancellated structure, a wave structure, a scaly structure or the like.

The base 30 is made of conducting material and could be a metal screw type base. The base 30 is positioned below the handle portion 102 of the heat dissipating plane 10 and can be mounted with the two transparent elements 20. The transparent elements 20 can be engaged or cohered to the base 30. Each of the transparent elements 20 comprises a neck portion 23, which assembles with an opening 32 of the base 30. The base 30 could also be electrically engaged with the LED elements 12. For instance, when the base is mounted on a lamp holder (not shown) the current flows to the base 30 so that the LED elements 12 start operating.

When the current flows though the LED elements 12, the LED elements 12 emit light and generate heat. The heat dissipating plane 10 will absorb the heat generated by the LED elements 12 and then dissipate the heat by itself and by the first embossment 14 or the first recess 16. The transparent elements 20 also dissipate heat and allow the LED elements 12 to operate in a relatively low temperature. Furthermore, the heat dissipating plane 10 can be shaped so that a plurality of LED elements 12 can form not only on the periphery of the heat dissipating plane 10 but also at any place on the sides of the heat dissipating plane 10. In this case, the different position of the LEDs could alter the light projection angle without limiting it in a certain range.

Figure 5:
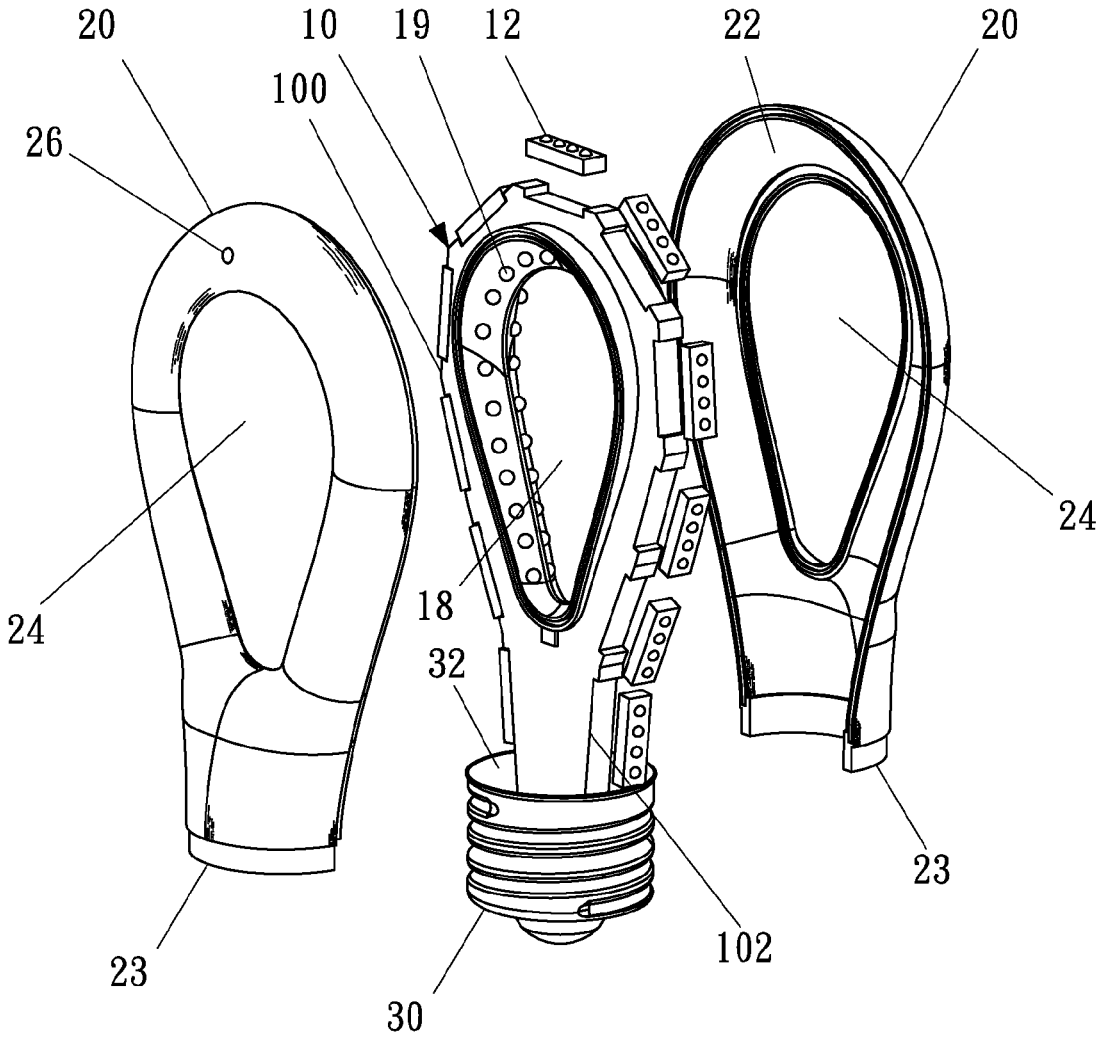
FIG. 5 is an exploded view of LED lamp structure according to a third embodiment of present invention.
Figure 6:
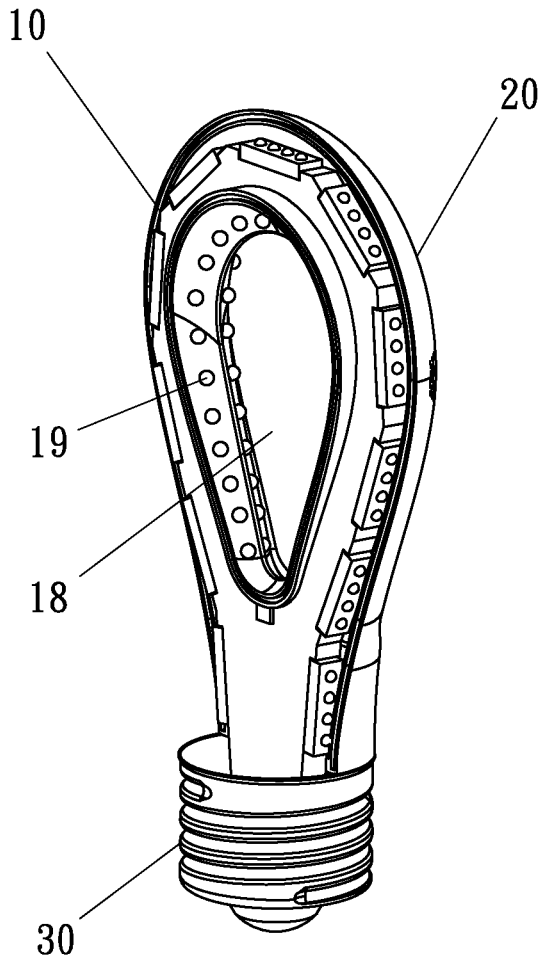
FIG. 6 is a partly assembled perspective view of a LED lamp structure according to a third embodiment of the present invention.
Figure 7:
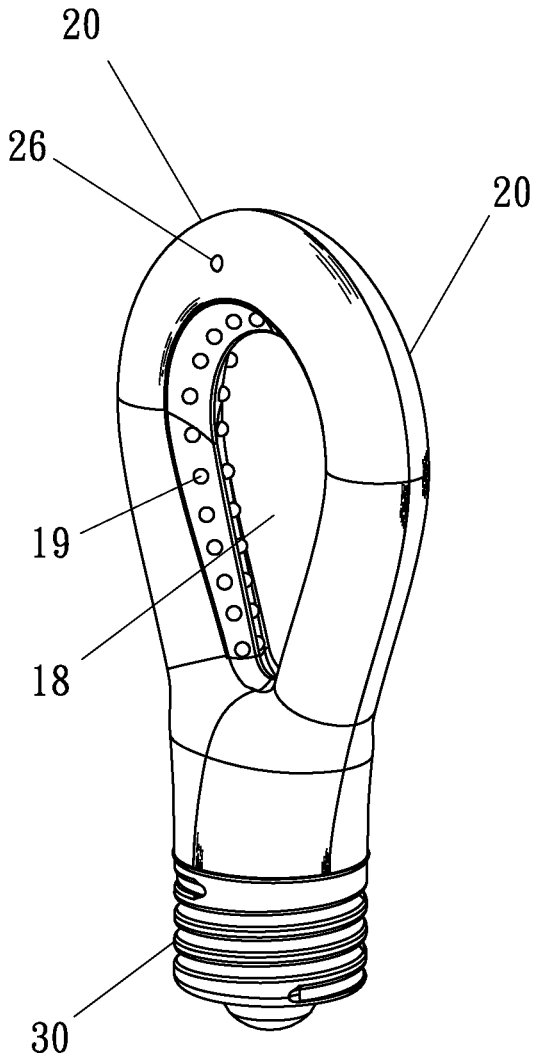
FIG. 7 is a perspective view of a LED lamp structure according to a third embodiment of the present invention.

FIGS. 5~7 show a LED lamp structure constructed according to the third embodiment of the present invention. The following description focuses on the main differences between the first embodiment and the third embodiment. According to this embodiment, the heat dissipating plane 10 comprises a second hollow region 18, which is constructed with the first hollow region 24 to provide a fully penetrating structure. Furthermore, the second hollow region 18 can also increase the heat dissipating area of the heat dissipating plane 10. In addition, this embodiment allows the LED to generate higher light output without adverse temperature-related effects. Besides, the second hollow region 18 also has a third embossment 28 or a third recess 28 to increase the overall heat dissipating area and dissipate heat efficiently. The third embossment 28 could be a lamellar structure, a schistose structure, an embossing surface or the like. Furthermore, the third recess 28 could be a cancellated structure, a wave structure, a scaly structure or the like.

Figure 8:
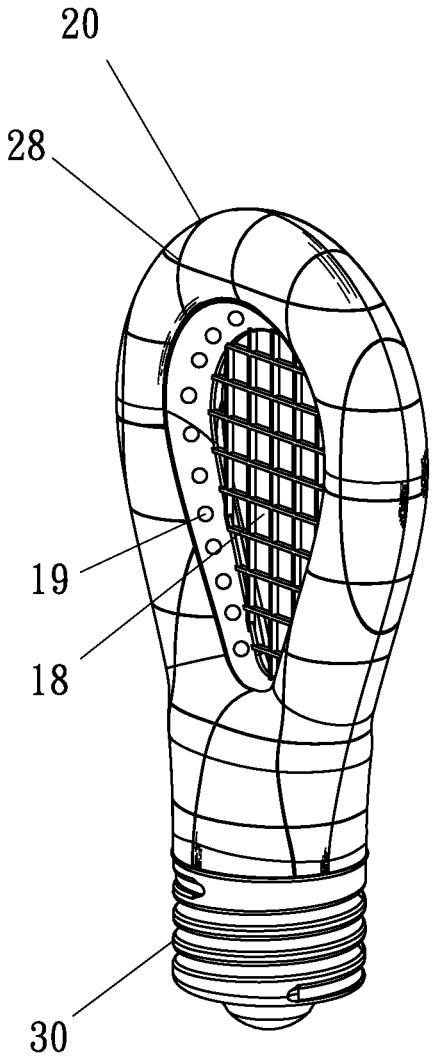
FIG. 8 is a perspective view of a LED lamp structure according to a fourth embodiment of the present invention.

As shows in FIG. 8, the second hollow region 18 can also be a cancellated structure. With the cancellated structure, the LED lamp structure could dissipate more heat into the air.

The present invention has been demonstrated herein by reference to the preferred embodiments. However, it is understood that the embodiments are not intended to limit the scope of the present invention, which is defined only by the appended claims. Therefore, any changes or modifications that are based on the contents disclosed herein and do not depart from the spirit of the present invention should be encompassed by the appended claims.

What is claimed is:

1. A light emitting diode lamp structure, comprising:

a heat dissipating plane comprising a plurality of light emitting diodes;

a light emitting housing comprising a casing and a first hollow region, wherein the heat dissipation plane is partly covered by the light emitting housing and partly shown through the first hollow region, and the plurality of light emitting diodes are covered by the light emitting housing; and a base mounted with the light emitting housing and electrically engaged with the light emitting diodes;

wherein a part of the heat dissipating plane shown through the first hollow region further comprises a first embossment or a first recess; and wherein the light emitting housing is construed by a combination of two transparent elements, and each of the transparent elements further comprises a second embossment or a second recess on an outer surface of each of the transparent elements.

2. The light emitting diode lamp structure according to claim 1, wherein the first embossment is a lamellar structure, a schistose structure, or an embossing surface, and first recess is a cancellated structure, a wave structure, or a scaly structure.

3. The light emitting diode lamp structure according to claim 1, wherein the heat dissipating plane shown through the first hollow region further comprises a second hollow region.

4. The light emitting diode lamp structure according to claim 3, wherein the second hollow region is a through hole or a cancellated structure.

5. The light emitting diode lamp structure according to claim 4, wherein a surface of the second hollow region further comprises a third embossment or a third recess.

6. The light emitting diode lamp structure according to claim 5, wherein the said third embossment is a lamellar structure, a schistose structure, or an embossing surface; and the said third recess a cancellated structure, a wave structure, or a scaly structure.

7. The light emitting diode lamp structure according to claim 1, wherein the light emitting housing is made of glass or acrylic.

8. The light emitting diode lamp structure according to claim 1, wherein the second embossment is a lamellar structure, a schistose structure, or an embossing surface, and the second recess is a cancellated structure, a wave structure, or a scaly structure.

* * * * *